US010865011B2

(12) United States Patent
Sakaguchi

(10) Patent No.: US 10,865,011 B2
(45) Date of Patent: Dec. 15, 2020

(54) CONTAINER

(71) Applicant: Eisai R&D Management Co., Ltd., Tokyo (JP)

(72) Inventor: Takahisa Sakaguchi, Gifu (JP)

(73) Assignee: Eisai R&D Management Co., Ltd., Tokyo (JP)

( * ) Notice: Subject to any disclaimer, the term of this patent is extended or adjusted under 35 U.S.C. 154(b) by 0 days.

(21) Appl. No.: 16/467,730

(22) PCT Filed: Jan. 5, 2018

(86) PCT No.: PCT/JP2018/000058
§ 371 (c)(1),
(2) Date: Jun. 7, 2019

(87) PCT Pub. No.: WO2018/128188
PCT Pub. Date: Jul. 12, 2018

(65) Prior Publication Data

US 2020/0062442 A1 Feb. 27, 2020

(30) Foreign Application Priority Data

Jan. 6, 2017 (JP) ..... 2017-000895

(51) Int. Cl.
*B65D 5/66* (2006.01)
*A61J 1/03* (2006.01)
*A61J 1/16* (2006.01)

(52) U.S. Cl.
CPC ..... *B65D 5/6679* (2013.01); *A61J 1/035* (2013.01); *A61J 1/16* (2013.01)

(58) Field of Classification Search
CPC ..... B65D 5/6679; A61J 1/035; A61J 1/16
(Continued)

(56) References Cited

U.S. PATENT DOCUMENTS 1,731,414 A 10/1929 Grossman
2,493,338 A * 1/1950 Buttery ..... B65D 5/3642 229/117.03

(Continued)

FOREIGN PATENT DOCUMENTS

AU 2005209682 12/2006
CN 1223493 10/2005

(Continued)

OTHER PUBLICATIONS

International Preliminary Report on Patentability in International Application No. PCT/JP2018/000058, dated Jul. 9, 2019, 12 pages (English Translation).

(Continued)

*Primary Examiner* — Jacob K Ackun
(74) *Attorney, Agent, or Firm* — Fish & Richardson P.C.

(57) ABSTRACT

Provided is a container including a main body, a lid body, and a fixing mechanism that fixes the lid body to prevent the lid body from opening from the main body when the lid body is closed, the fixing being released when the lid body moves to a front side with respect to the main body. Cutouts are formed in side plates of the main body. The container is configured such that, by a rear plate tilting forward toward the cutouts of the side plates, the lid body moves to the front side with respect to the main body and the fixing of the lid body is released, and as the rear plate and a top plate of the lid body form a single plane, the top plate rises and the lid body opens.

17 Claims, 15 Drawing Sheets

(58) Field of Classification Search
USPC ..... 229/117.01, 117.03; 206/528, 756, 736, 206/536
See application file for complete search history.

(56) References Cited

U.S. PATENT DOCUMENTS

| | | | | |
|---|---|---|---|---|
| 3,610,513 | A | 10/1971 | Hosek | |
| 3,921,895 | A * | 11/1975 | Ziche | B65D 5/5021 206/486 |
| 4,081,128 | A * | 3/1978 | O'Neill | B65D 5/723 206/536 |
| 2004/0050748 | A1 | 3/2004 | Ehrlund | |
| 2005/0173291 | A1* | 8/2005 | Specker | B65D 77/046 206/536 |
| 2006/0144746 | A1 | 7/2006 | Katsuyama | |
| 2007/0272586 | A1 | 11/2007 | Hession | |
| 2019/0367210 | A1* | 12/2019 | Smith | B65D 5/28 |

FOREIGN PATENT DOCUMENTS

| | | |
|---|---|---|
| CN | 204323843 | 5/2015 |
| DE | 29916421 | 1/2000 |
| FR | 1040140 | 10/1953 |
| FR | 2861370 | 4/2005 |
| JP | 2004-513035 | 4/2004 |
| JP | 2005-178819 | 7/2005 |
| JP | 2007-517615 | 7/2007 |
| JP | 3138804 | 12/2007 |
| JP | 2010-018289 | 1/2010 |

OTHER PUBLICATIONS

Office Action in Chinese Patent Application No. 201880004517.4, dated Apr. 17, 2020, 9 pages (with Manual English Translation).
Search Report in Chinese Patent Application No. 201880004517.4. dated Apr. 11, 2020, 4 pages (with Manual English Translation).
Extended European Search Report in European Patent Application No. 18736438.5, dated Jul. 31, 2020, 5 pages.
Response filed in Chinese Patent Application No. 201880004517.4, dated Aug. 7, 2020, to the Office Action dated Apr. 17, 2020, 28 pages (with Manual English Translation).
International Search Report for PCT/JP2018/000058 dated Mar. 6, 2018 with English translation.
Request for the Examination in Taiwanese Patent Application No. 107100405, dated Oct. 5, 2020, 6 pages (with English Translation).
Response to Telephonic Notice in Chinese Patent Application No. 201880004517.4, dated Sep. 22, 2020, 14 pages (with English Translation).
Response to Telephonic Notice in Chinese Patent Application No. 201880004517.4, dated Sep. 29, 2020, 13 pages (with English Translation).
Notice of Allowance in Chinese Patent Application No. 201880004517.4, dated Oct. 19, 2020, 8 pages (with English Translation).

* cited by examiner

A-A

CONTAINER

TECHNICAL FIELD

This Application is based upon Japanese Patent Application No. 2017-000895 filed on Jan. 6, 2017, the described content of which is incorporated herein by reference.

The present invention relates to a container that stores a stored object.

BACKGROUND ART

As a container that stores a stored object, there is a container having a lock function to prevent a lid from opening.

For example, some PTP (press through pack) sheet of a drug is stored and kept in a package. In this case, the PTP sheet is taken out from the package when the drug is used. Some packages of this type include a lock function called CR (child resistant) function in order to, for example, prevent accidental ingestion of drugs by children. As this type of package, for example, there is a package configured such that a blister card on the inside of the package is pulled while pressing down a pressing section (a releasing mechanism) formed on the surface of the package (see, for example, Patent Document 1).

CITATION LIST

Patent Document

Patent Document 1: Japanese Translation of PCT Application No. 2007-517615

SUMMARY

Technical Problem

However, in the structure explained above, operation for pushing the releasing mechanism of the package and operation for pulling out the blister card are necessary before the drug is taken out. Therefore, operation is complicated and handling is difficult for a user such as an aged person.

The present invention has been devised in view of such a point. That is, an object of the present invention is to provide a container from which a stored object such as a PTP sheet can be easily taken out, although the container includes a fixing function for a lid body.

Solution to Problem

A container according to an aspect of the present invention includes: a main body including at least a bottom plate, a front plate present on a front side surface, a rear plate present on a rear side surface, and side plates present on left and right side surfaces; a lid body including at least a top plate that is connected to an upper end of the rear plate and covers an upper side of the main body, the lid body being capable of opening and closing the upper side of the main body; and a fixing mechanism that fixes the lid body to prevent the lid body from opening from the main body when the lid body is closed, the fixing being released when the lid body moves to a front side with respect to the main body. Cutouts are formed in the side plates of the main body. The container is configured such that, by the rear plate tilting forward toward the cutouts of the side plates, the lid body moves to the front side with respect to the main body and the fixing of the lid body is released, and as the rear plate and the top plate form a single plane, the top plate rises and the lid body opens.

According to this aspect, when a user pushes the rear plate of the main body to tilt the rear plate forward, the fixing of the lid body to the main body is released and the user can open the lid body. The user can easily take out a stored object present in the container.

The fixing mechanism may include a fixing plate that holds a front end portion of the bottom plate of the main body from below and fixes the lid body to prevent the lid body from opening. According to this aspect, it is possible to realize the fixing mechanism having a simple configuration. Since the fixing plate is present in a position apart from the rear plate operated to release the fixing of the lid body, for example, a child pays attention to the vicinity of the fixing plate. Therefore, for example, the child less easily notices that the child can release the fixing by pushing the rear plate. Further, the fixing plate is present in the bottom of the container. Therefore, for example, the child less easily notices that the child can release the fixing. According to this aspect, it is possible to improve a CR function of the container.

The lid body may include a first lid side plate and a second lid side plate on left and right. The fixing plate may be formed from the first lid side plate to the second lid side plate. According to this aspect, it is possible to realize the fixing mechanism with a simple configuration.

Rear ends of the side plates may incline to be gradually higher toward the front side. The cutouts may be formed in a triangular shape. According to this aspect, it is possible to appropriately and surely perform a forward tilting motion of the rear plate.

The container may further include a plate that is stored in the main body and that holds a stored object. According to this aspect, it is possible to appropriately and surely hold the stored object.

The plate may be connected to the bottom plate of the main body. According to this aspect, it is possible to appropriately connect the plate and the main body.

The plate may be detachably attached to the main body. According to this aspect, it is possible to replace the plate.

Length of the plate in a front-rear direction may be set substantially the same as length of an internal space of the main body in the front-rear direction. Note that "substantially the same" includes lengths that can be considered the same, for example, lengths, the difference between which is up to 10 mm. According to this aspect, when it is attempted to shift the main body to the rear side with respect to the lid body to release the fixing of the lid body, the plate on the inside of the main body prevents the movement of the main body. Therefore, it is possible to assist a fixing function for the lid body by the fixing mechanism.

The plate may include a plurality of plate sections. The plurality of plate sections may be connected in series and configured to be able to be folded back in the connecting portions of the plurality of plate sections. According to this aspect, the plate sections can be three-dimensionally used to take a laminated structure. Therefore, the plate can hold a sufficient amount of the stored object.

The plate may include a first plate section connected to the bottom plate of the main body, a second plate section connected to the first plate section, and a third plate section connected to the second plate section. The stored object may be held by the second plate section and the third plate section. According to this aspect, since the stored object is held by the second plate section and the third plate section on the upper side, it is possible to lift the second plate section and the third plate section flat to be in a state in which the stored object is easily taken out and take out the stored object or content of the stored object.

One end of the first plate section may be connected to a rear side of the bottom plate of the main body and another end of the first plate section may be located on the front side of the main body. One end of the second plate section may be connected to the first plate section and another end of the second plate section may be located on the rear side of the main body. One end of the third plate section may be connected to the second plate section and another end of the third plate section may be located on the front side of the main body. The lid body may include sidewalls that surround three side surfaces formed of the side surface on the front side and the left and right side surfaces. According to this aspect, it is possible to receive, with the first plate section, the content of the stored object taken out from the second plate section and the third plate section and store, within the sidewalls of the lid body, the content of the stored object dropped along the first plate section. According to this aspect, it is possible to suppress a drop of the content of the stored object. For example, for a user such as an aged person, it is possible to prevent a loss of the stored object. It is also possible to facilitate handling of the stored object.

A material of the plate may be selected from paper, synthetic resin, and metal.

A slope that rises toward the front side may be formed on an inner surface on the front side of the main body. According to this aspect, when the rear plate tilts forward, the plate pushes the slope. Therefore, a force in the downward direction acts on the main body. For example, it is possible to help the lid body to open.

A PTP sheet may be stored in the container explained above. At least one selected from a dividedly packed product of a drug, a one-dose package of a plurality of drugs, and a kit preparation of an injection may be stored in the container explained above.

A material of the container may be selected from paper, synthetic resin, and metal. The material of the container may be paper.

Advantageous Effects of Invention

According to the present invention, it is possible to provide a container including a fixing function for a lid body, a stored object or content of the stored object being able to be easily taken out from the container.

DESCRIPTION OF EMBODIMENTS

Figure 1:
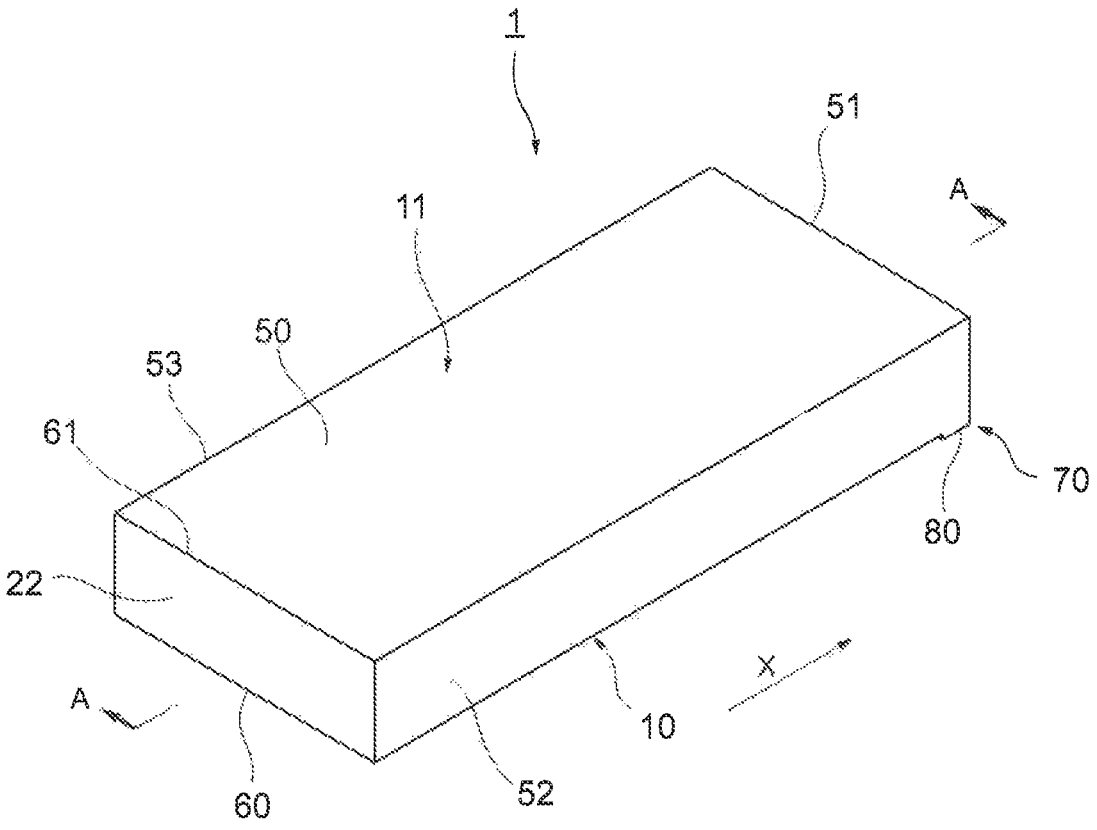
FIG. 1 is a perspective view showing a state in which a lid body of a container is closed.

A preferred embodiment of the present invention is explained below with reference to the drawings. Note that the same elements are denoted by the same reference numerals and signs and redundant explanation of the elements is omitted. Positional relations such as top and bottom and left and right are based on positional relations shown in the drawings unless specifically noted otherwise. Further, dimension ratios of the drawings are not limited to ratios shown in the drawings. Note that the embodiment explained below is an illustration for explaining the present invention. Therefore, the present invention is not limited to this embodiment.

Figure 2:
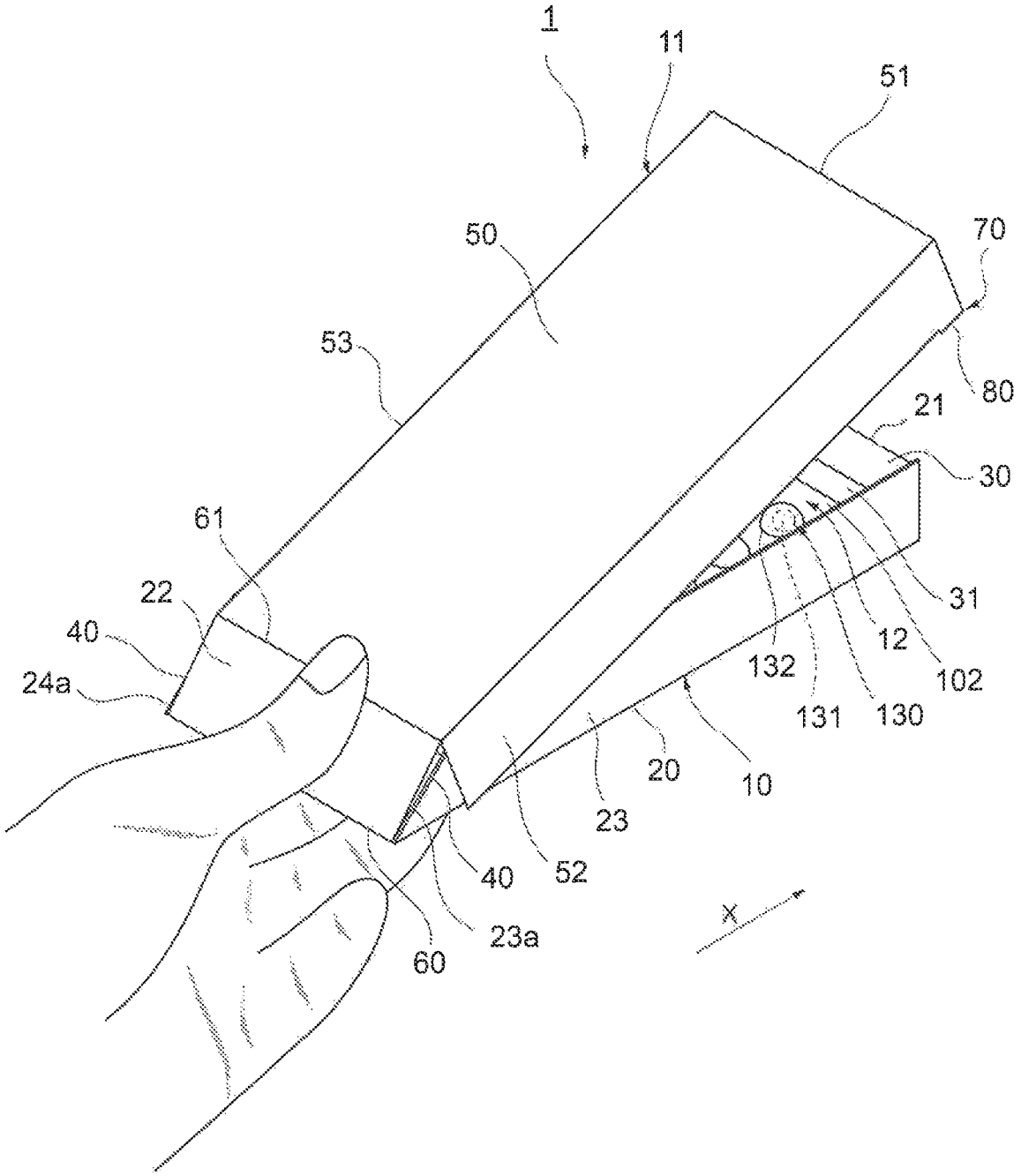
FIG. 2 is a perspective view showing a state in which the lid body of the container is opened.
Figure 3:
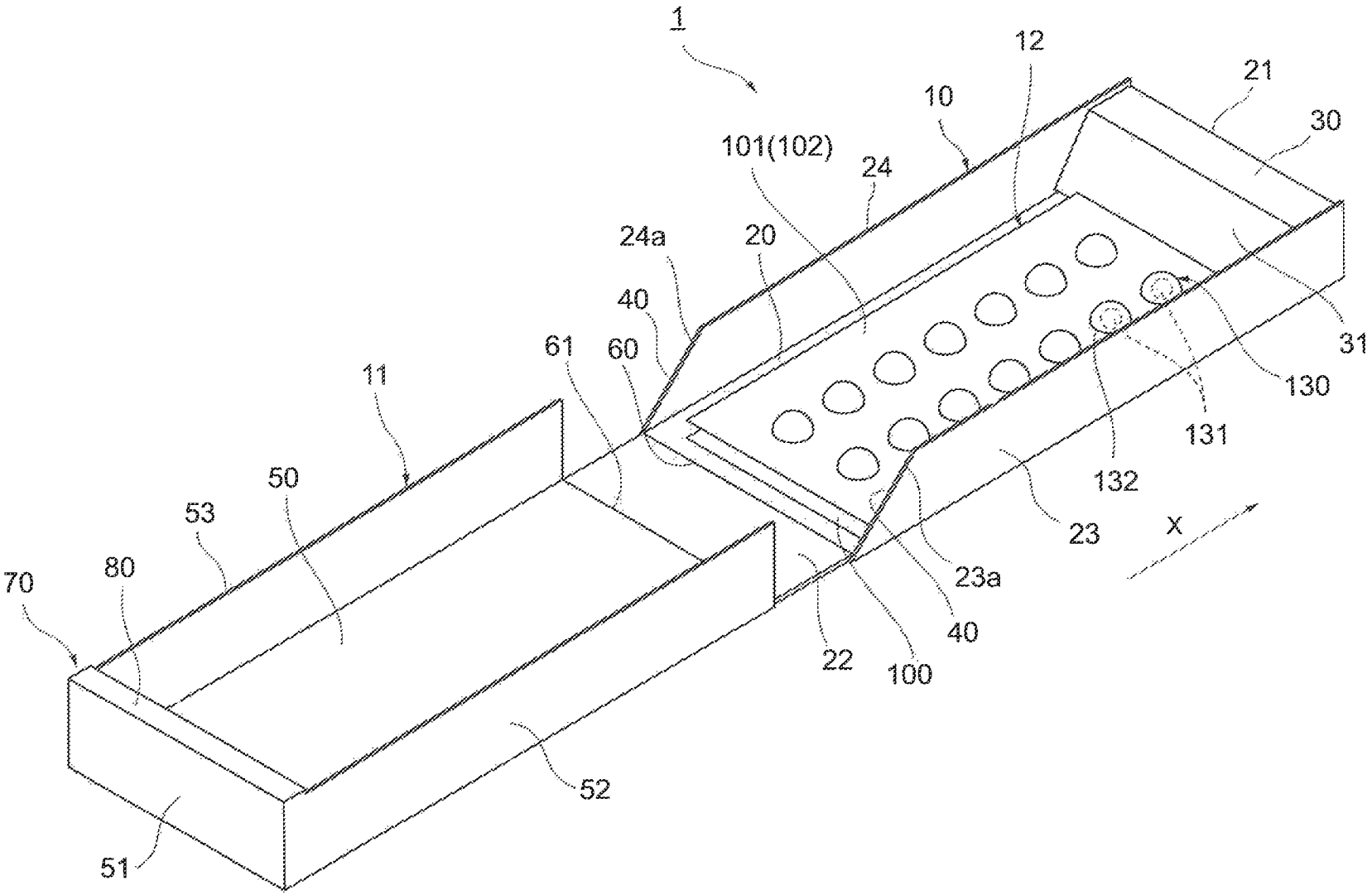
FIG. 3 is an explanatory diagram showing a state in which the lid body of the container is opened 180 degrees.

FIG. 1 is a perspective view showing a state in which a lid body 11 of a container 1 according to this embodiment is closed. FIG. 2 is a perspective view showing a state in which the lid body 11 of the container 1 is opened. FIG. 3 is a perspective view showing a state in which the lid body 11 of the container 1 is opened 180 degrees.

As shown in FIG. 1, the container 1 has a substantially rectangular parallelepiped shape. The container 1 includes, as shown in FIG. 2 and FIG. 3, for example, a main body 10, the lid body 11, and a plate 12 that holds a stored object. The container 1 is made of, for example, paper. JET star (350 g/m$^2$) and JET ace W35 (400 g/m$^2$) manufactured by Dainippon Showa Paperboard Co., Ltd can be used. However, the material of the container 1 is not limited to this and may be synthetic resin, metal, and the like. When the material of the container 1 is synthetic resin, the synthetic resin may be polyvinyl chloride.

Figure 4:
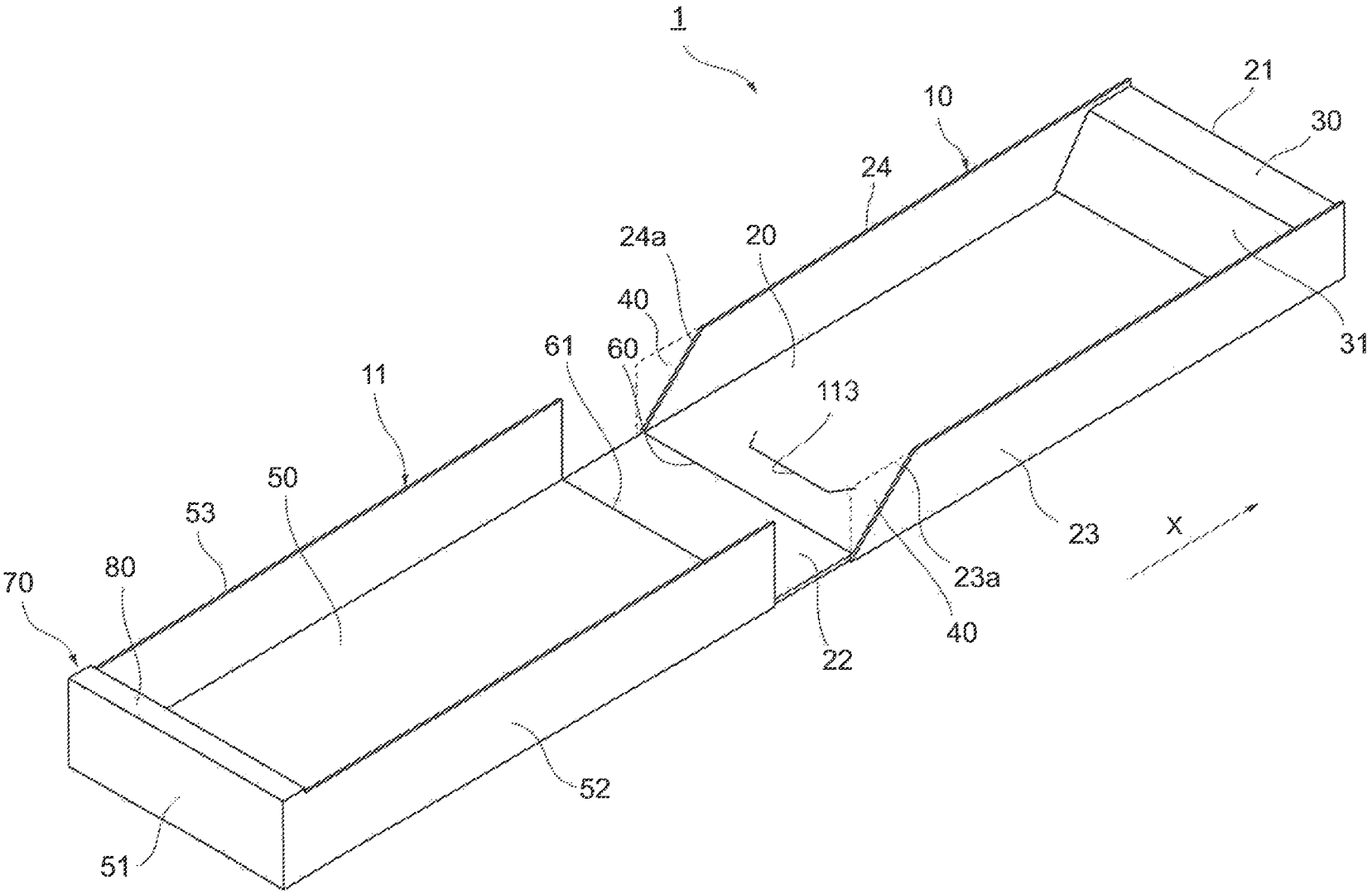
FIG. 4 is an explanatory diagram showing a configuration of the container at the time when a plate is detached.

The main body 10 includes, as shown in FIG. 3 and FIG. 4, a rectangular bottom plate 20, a front plate 21 present on a side surface on a front side (an X-direction side in FIG. 1 to FIG. 4) in the longitudinal direction of the bottom plate 20, a rear plate 22 present on a side surface on a rear side (the opposite side in the X direction in FIG. 1 to FIG. 4), and side plates 23 and 24 present on side surfaces in a left-right direction (a horizontal direction perpendicular to the X direction in FIG. 1 to FIG. 4: a width direction) of the bottom plate 20. That is, the main body 10 includes the front plate 21, the rear plate 22, and the side plates 23 and 24. When the lid body 11 is closed, four surfaces around the bottom plate 20 can be surrounded by the front plate 21, the rear plate 22, and the side plates 23 and 24. In a state in which the lid body 11 is opened, the upper side of the main body 10 is opened. Note that FIG. 4 shows the container 1 in a state in which the plate 12 removed, that is, the container 1 in a state in which the lid body 11 is opened 180 degrees.

Figure 5:
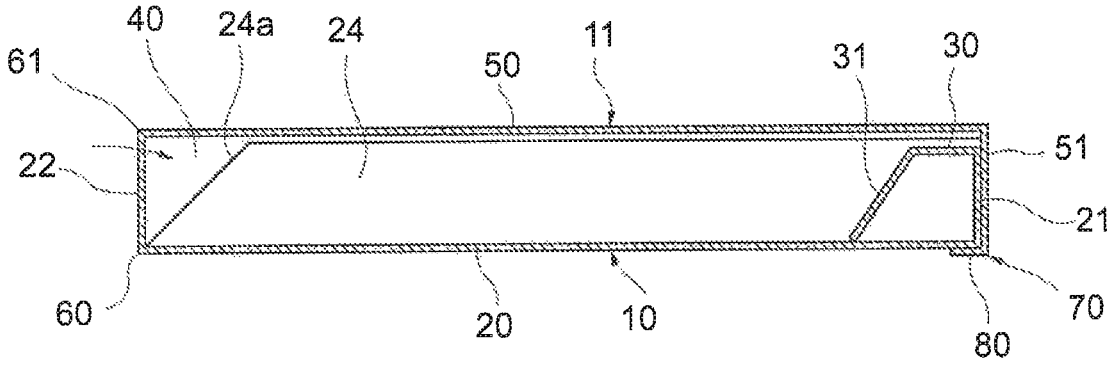
FIG. 5 is an A-A sectional view of the container.

As shown in FIG. 4 and FIG. 5, on the rear side of the front plate 21, a flat surface 30 connected to the upper end portion of the front plate 21, and a slope 31 that falls from the rear end portion of the flat surface 30 toward the rear side are formed. That is, the slope 31 that rises toward the front of the main body 10 is formed on the inner surface on the rear side of the front plate 21.

Cutouts 40 are formed at rear ends 23*a* and 24*a* of the side plates 23 and 24. The rear ends 23*a* and 24*a* of the side plates 23 and 24 are inclined to be gradually higher toward the front side, whereby the cutouts 40 are formed in a triangular shape. The cutouts 40 prevent the rear plate 22 from being fixed to the side plates 23 and 24. Since a space is formed on the front side of the rear plate 22, the rear plate 22 can be tilted forward with a bend line 60 between the rear plate 22 and the bottom plate 20 as an axis. Consequently, it is possible to prevent the container 1 from being broken.

The lid body 11 includes, as shown in FIG. 1 to FIG. 5, a rectangular top plate 50, a lid front plate 51 present on a side surface on the front side in the longitudinal direction of the top plate 50, and a lid side plate (a first lid side plate) 52 and a lid side plate (a second lid side plate) 53 present on side surfaces in the width direction of the top plate 50. That is, sidewalls are formed on three side surfaces surrounding the periphery of the top plate 50. Note that "front" and "rear" for explaining the members of the lid body 11 indicate directions at the time when the lid body 11 is closed.

The rear end of the top plate 50 is connected to the upper end of the rear plate 22 of the main body 10 via a bend line 61. The lid body 11 turns to the front side with the bend line 61 and the bend line 60 at the lower end of the rear plate 22 as axes. When the lid body 11 is closed, the top plate 50 covers an opening upper side, the side plates 23 and 24, and the front plate 21 of the main body 10 from above and the lid front plate 51 covers the front plate 21 of the main body 10 from the outer side. The lid side plates 52 and 53 cover the side plates 23 and 24 of the main body 10 from the outer side. As shown in FIG. 3, the lid body 11 turns to the rear side with the bend line 60 and the bend line 61 as axes. The lid body 11 can be opened until an angle formed by the bottom plate 20 and the top plate 50 reaches at least approximately 180 degree.

The lid body 11 includes a fixing mechanism (a lock function) 70 that fixes the lid body 11 to prevent the lid body 11 from opening from the main body 10 when the lid body 11 is closed, the fixing of the lid body 11 being released when the lid body 11 moves to the front side with respect to the main body 10.

Figure 6:
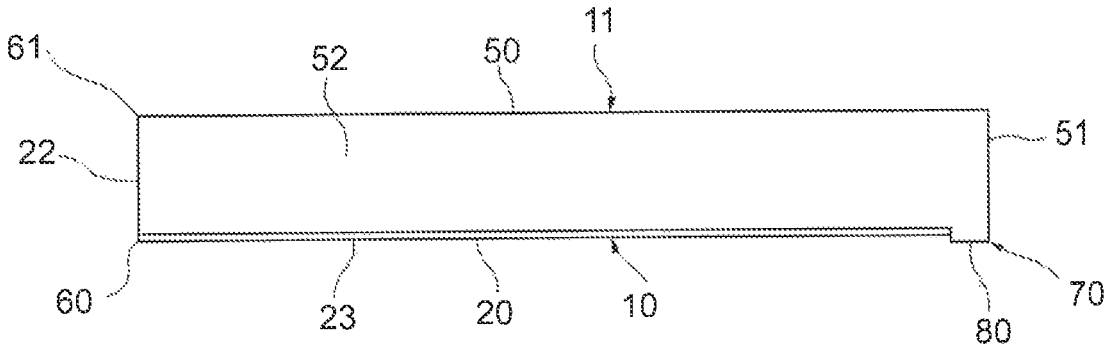
FIG. 6 is a side view of the container.
Figure 7:
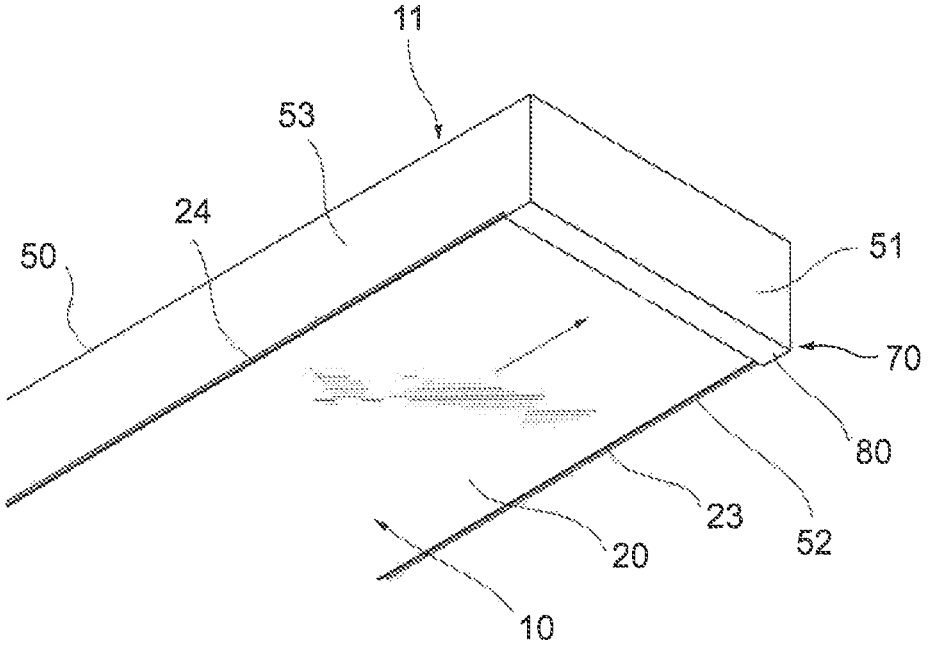
FIG. 7 is an explanatory diagram showing a fixing mechanism of the container.

The fixing mechanism 70 includes, as shown in FIG. 5, FIG. 6, and FIG. 7, a fixing plate 80 that holds the front end portion of the bottom plate 20 of the main body 10 from below and fixes the lid body 11 to prevent the lid body 11 from opening. The fixing plate 80 is formed from the lower end of the lid side plate 52 to the lower end of the lid side plate 53 at the front end portions of the lid side plates 52 and 53. In a state in which the lid body 11 is closed, the front end portion of the main body 10 enters the inner side (the upper side) of the fixing plate 80. The main body 10 is caught by the fixing plate 80. The lid body 11 is fixed to prevent the lid body 11 from opening. When the lid body 11 relatively moves forward with respect to the main body 10 and the front end portion of the main body 10 comes off the fixing plate 80, the fixing of the lid body 11 is released.

Figure 8:
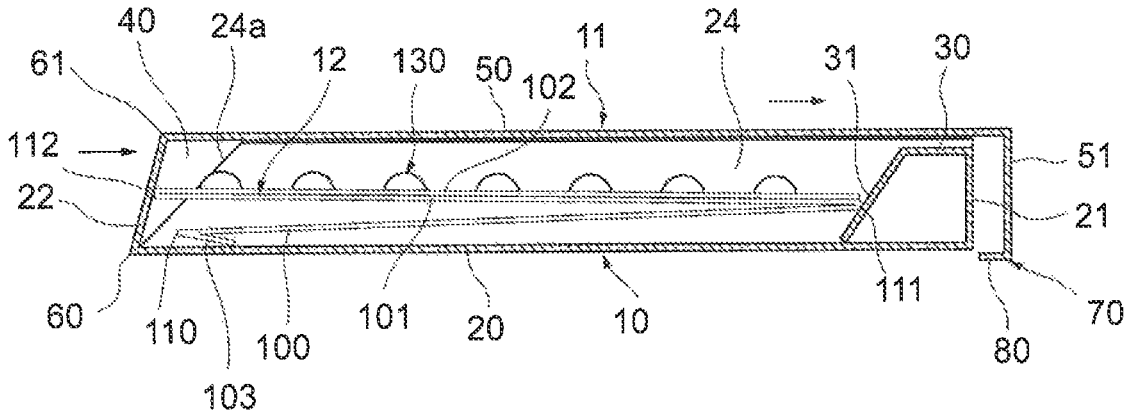
FIG. 8 is an explanatory diagram of a cross section of the container showing a state in which a rear plate is tilted forward.
Figure 9:
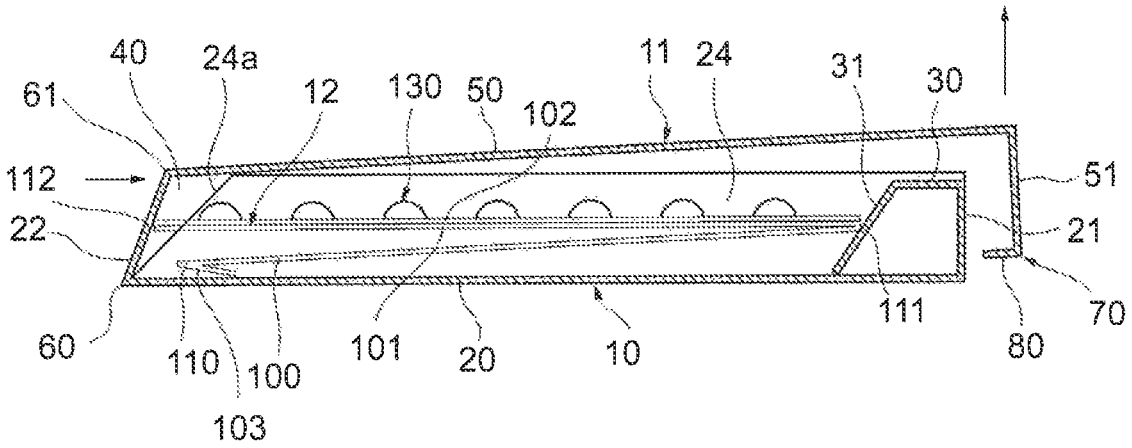
FIG. 9 is an explanatory diagram of a cross section of the container showing a state in which fixing of the lid body is released.
Figure 10:
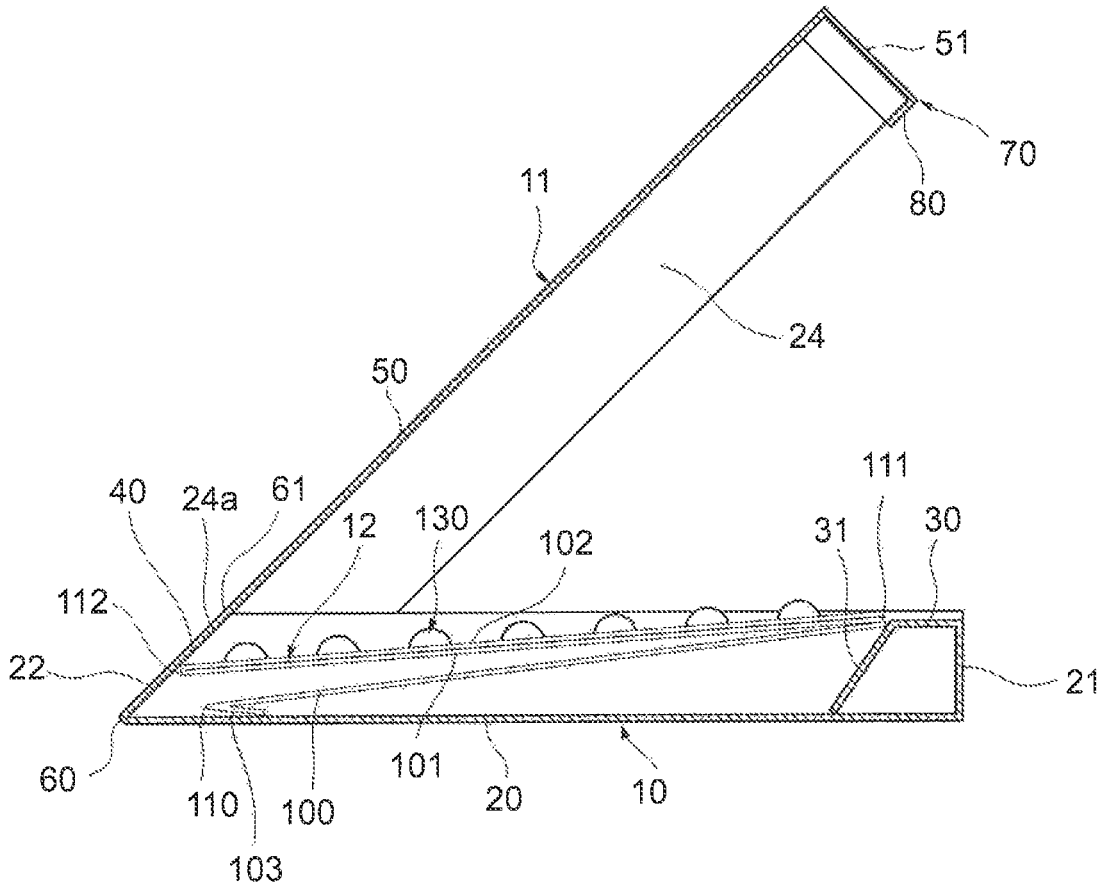
FIG. 10 is an explanatory diagram of a cross section of the container showing a state in which the lid body is opened.

As shown in FIG. 8 and FIG. 9, the rear plate 22 of the main body 10 is pushed toward the cutouts 40 of the side plates 23 and 24 and tilts forward, whereby the entire lid body 11 moves to the front side with respect to the main body 10 and the fixing of the lid body 11 is released. As shown in FIG. 10, when the rear plate 22 of the main body 10 is further pushed toward the cutouts 40 of the side plates 23 and 24 and tilts forward, the top plate 50 and the rear plate 22 form a single plane (an interior angle formed by the top plate 50 and the rear plate 22 in the bend line 61 approaches 180 degree). At the same time, the front side of the top plate 50 rises and the lid body 11 opens. At this time, the side plates 23 and 24 of the main body 10 support the top plate 50 from below. Note that, in the state in which the lid body 11 is open, as shown in FIG. 10, the top plate 50 and the rear plate 22 do not have to form a single plane completely. The interior angle formed by the top plate 50 and the rear plate 22 in the bend line 61 may be smaller than 180 degrees or may exceed 180 degrees if the interior angle approaches 180 degrees.

As shown in FIG. 8 to FIG. 10, the plate 12 is stored in the main body 10. The plate 12 is connected to the bottom plate 20 of the main body 10. The plate 12 is made of paper, which is the same material as the material of the main body 10 and the lid body 11 explained above. However, the material of the plate 12 is not limited to this and may be, for example, synthetic resin or metal.

Figure 11:
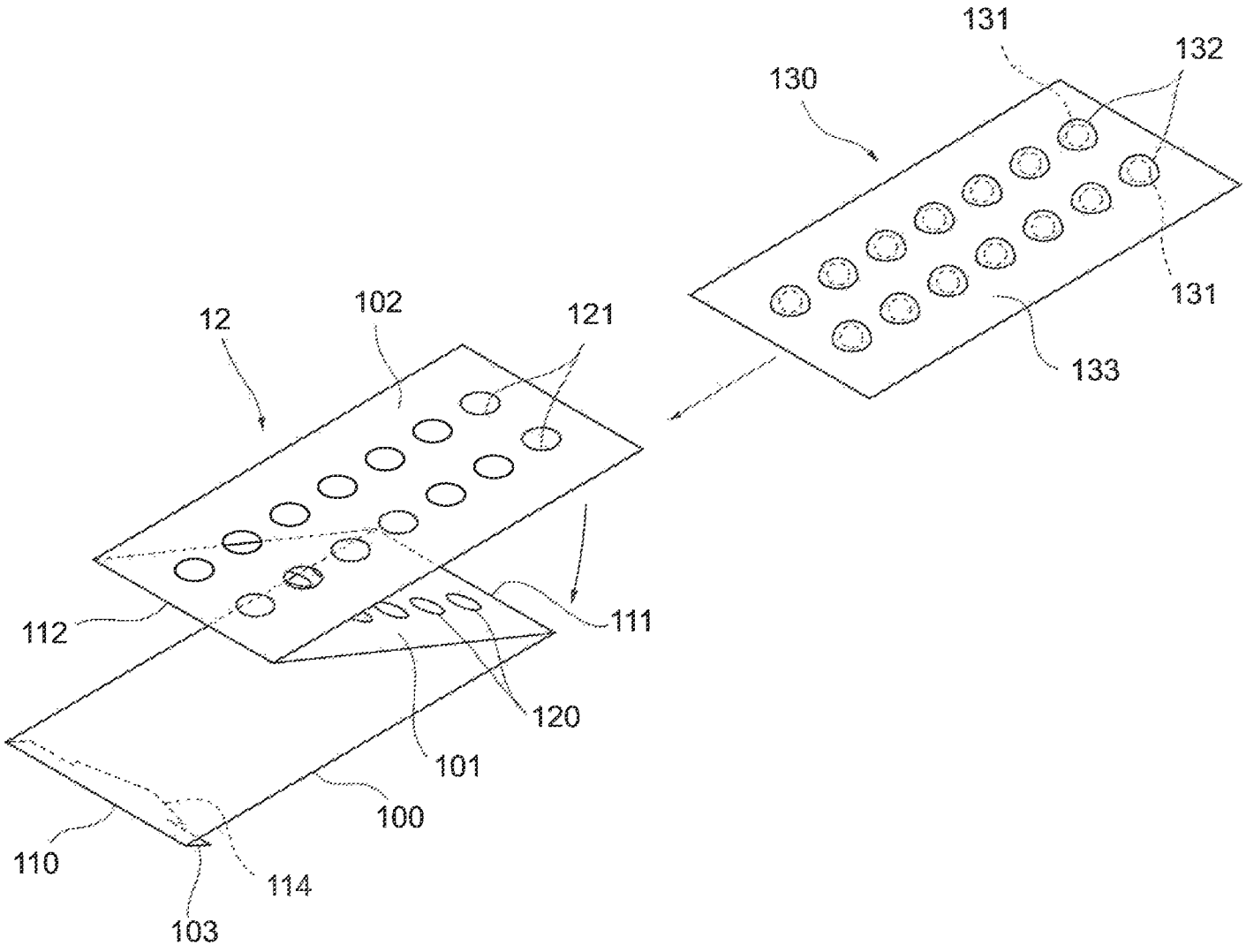
FIG. 11 is an explanatory diagram showing the configuration of the plate.

As shown in FIG. 11, the plate 12 includes a plurality of, for example, three plate sections 100, 101, and 102 and a coupling section 103. The coupling section 103 and the plate sections 100, 101, and 102 are connected in series in this order and configured to be able to be folded back in connecting portions 110, 111, and 112 of the coupling section 103 and the plate sections 100, 101, and 102.

Figure 12:
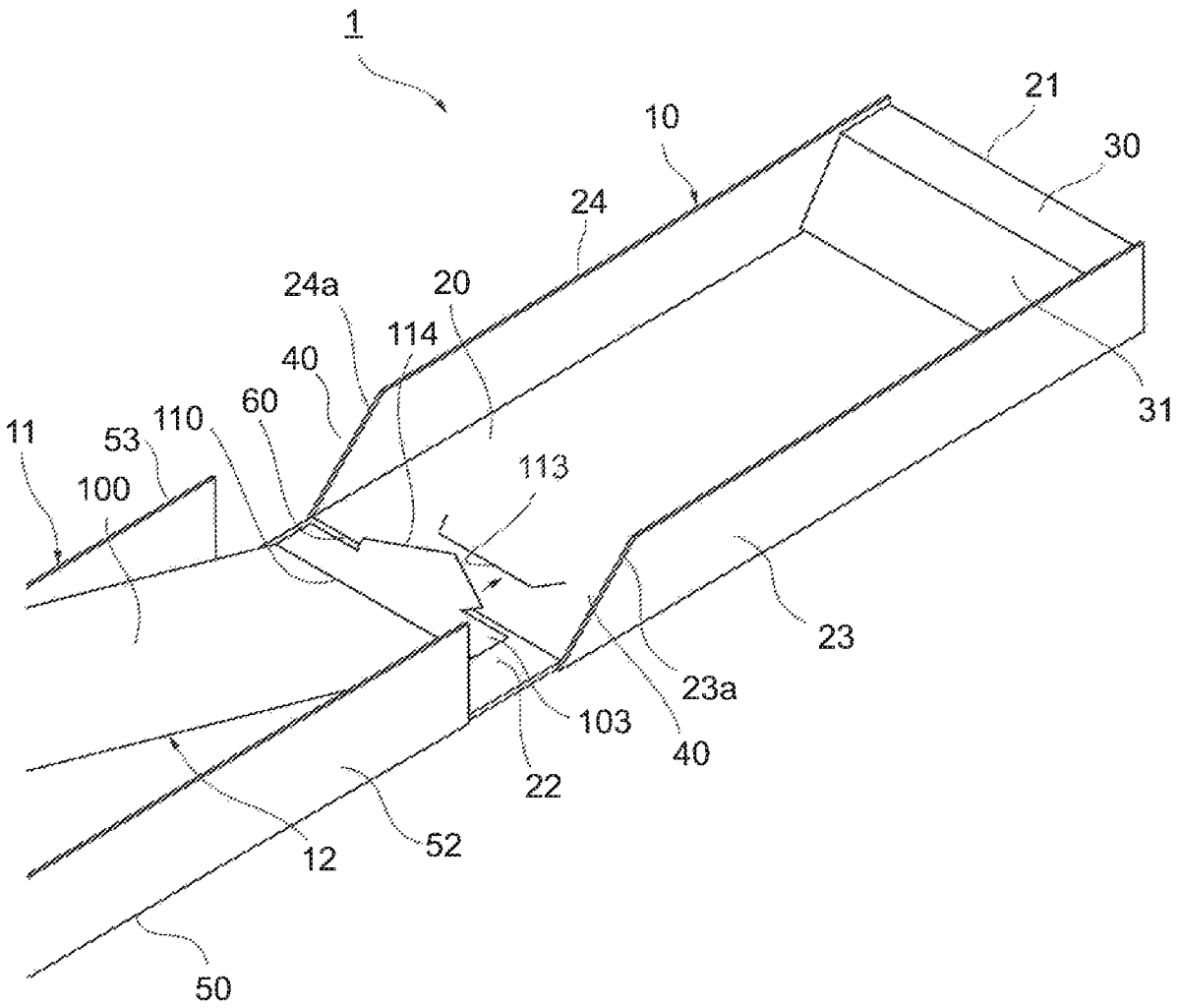
FIG. 12 is an explanatory diagram showing a coupling section of the plate.

The coupling section 103 includes, as shown in FIG. 12, a locking section 114 that is insertable into and lockable in a slit 113 formed in the bottom plate 20. Consequently, the plate 12 can be attached to and detached from the main body 10. The distal end portion of the coupling section 103 is formed in an arrow shape. As a result, the plate 12 is configured to be less easily detached from the main body 10. The plate 12 can be fixed without using an adhesive or the like.

The plate sections 100 to 102 are formed in a rectangular plate shape. The first plate section 100 is connected to the coupling section 103 and has a plane without holes.

In the second plate section 101 and the third plate section 102, pluralities of through-holes 120 and 121 corresponding to the positions of storing sections 132 of a PTP sheet 130 explained below are formed. The through-holes 120 and 121 are disposed to coincide when the second plate section 101 and the third plate section 102 are bent in the connecting portion 112 and superimposed each other.

Figure 13:
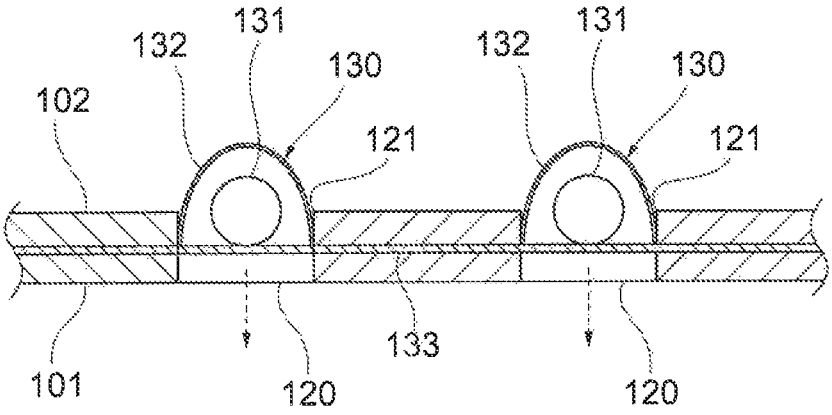
FIG. 13 is an explanatory diagram of a cross section of a laminated structure of a second plate section, a third plate section, and a PTP sheet.

The second plate section 101 and the third plate section 102 are bent and superimposed in a state in which the PTP sheet 130 serving as a stored object is held between the second plate section 101 and the third plate section 102. A bonding method for the second plate section 101, the PTP sheet 130, and the third plate section 102 is not particularly limited. For example, the bonding may be performed by applying an adhesive (which is not adhesive at normal temperature) to any portion of the PTP sheet 130, holding the PTP sheet 130 between the second plate section 101 and the third plate section 102, and melting the adhesive with heat using a dedicated press machine. Further, the second plate section 101, the PTP sheet 130, and the third plate section 102 may be bonded to one another by applying an adhesive (which is adhesive at normal temperature) to any portion of the PTP sheet 130, feeding the PTP sheet 130 to a belt conveyor in a state in which the PTP sheet 130 is held between the second plate section 101 and the third plate section 102, followed by pressurizing with a roller. As shown in FIG. 13, the storing sections 132 of drugs 131 of the PTP sheet 130 (content of the PTP sheet 130) are fit in the through-holes 121 of the third plate section 102. The through-holes 120 of the second plate section 101 are disposed on the rear surface side of the storing section 132 of the drugs 131. When the storing sections 132 are pushed from above the third plate section 102, the drugs 131 break a sheet 133 of the PTP sheet 130 and are discharged downward from the through-holes 120 of the second plate section 101.

Figure 14:
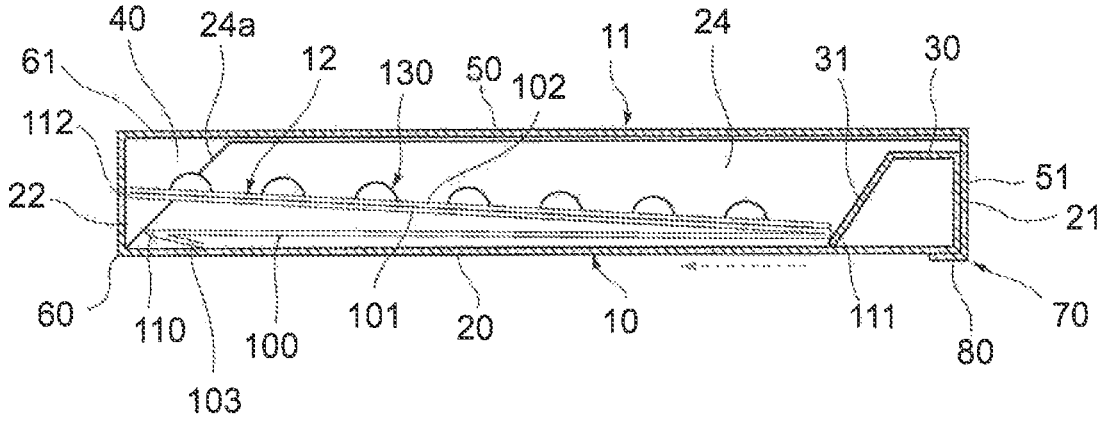
FIG. 14 is an explanatory diagram of a cross section of the container showing a state in which the plate is stored in a main body.

The plate 12 is coupled to the bottom plate 20 of the main body 10 by the coupling section 103 in the main body 10 as shown in FIG. 14. The connecting portion 110 of the coupling section 103 and the first plate section 100 is located near the rear end portion of the main body 10. The connecting portion 111 of the first plate section 100 and the second plate section 101 is located near the front end portion of the main body 10. The connecting portion 112 of the second plate section 101 and the third plate section 102 is located near the rear end portion.

The length of the plate 12 in the front-rear direction is set substantially the same as the length of an internal space of the main body 10 in the front-rear direction. That is, the length of the plate 12 in the front-rear direction is set to, for example, the same length as, length slightly larger than, or length slightly smaller than the length from the rear plate 22 to the slope 31. Consequently, even if it is attempted to shift the entire main body 10 to the rear side (an arrow direction in FIG. 14) with respect to the fixing plate 80 of the lid body 11 to release the fixing, since the plate 12 comes into contact with the slope 31 and the rear plate 22 in the main body 10, it is possible to suppress rearward movement of the main body 10. As shown in FIG. 9, when the rear plate 22 tilts forward and the lid body 11 moves to the front side with respect to the main body 10, the front end portion of the plate 12 comes into contact with the slope 31 and pushes the slope 31 in an obliquely downward direction (the normal direction of an inclined surface of the slope 31). Consequently, it is possible to help the lid body 11 to open.

Note that the main body 10 and the lid body 11 of the container 1 is manufactured by, for example, bending and assembling cut one piece of paper. The plate 12 is manufactured from another one piece of paper. The container 1 is manufactured by attaching the PTP sheet 130 to the plate 12 and attaching the plate 12 to the main body 10. As base paper of the container 1 and the plate 12, for example, thick coated cardboard (JET star (350 g/m$^2$) and JET ace W35 (400 g/m$^2$) manufactured by Dainippon Showa Paperboard Co., Ltd) is used.

A method of using the container 1 configured as explained above is explained. The plate 12 that holds the PTP sheet 130 is stored in the container 1 in advance. Before use, as shown in FIG. 1, the lid body 11 is closed, the front end portion of the main body 10 is inserted into the inner side of the fixing plate 80 of the lid body 11, and the lid body 11 and the main body 10 are fixed. At this time, even if a user attempts to open the lid body 11 upward, the lid body 11 is caught by the fixing plate 80 and cannot be opened.

When the user opens the lid body 11, the user pushes the rear plate 22. Consequently, as shown in FIG. 8, the rear plate 22 tilts forward and the lid body 11 moves to the front side with respect to the main body 10. As a result, as shown in FIG. 9, the fixing plate 80 projects further forward than the front end portion of the main body 10 and the fixing of the lid body 11 and the main body 10 is released. When the fixing of the lid body 11 is released and the rear plate 22 further tilts forward, as shown in FIG. 10 and FIG. 2, the top plate 50 of the lid body 11 rises to form a single plane with the rear plate 22, and the lid body 11 opens.

Figure 15:
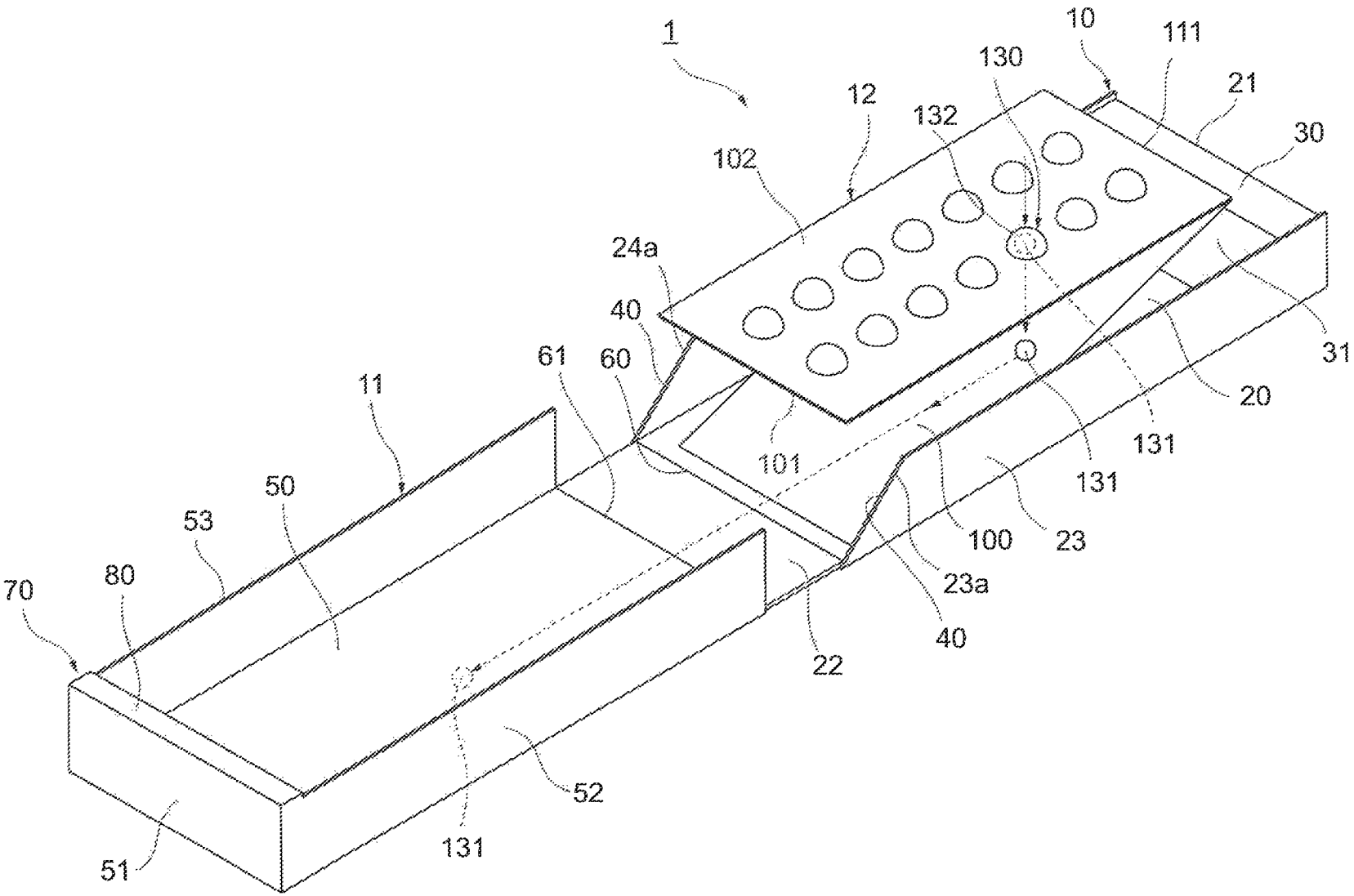
FIG. 15 is an explanatory diagram showing a state in which the lid body is opened 180 degrees and the plate is lifted.

When the lid body 11 opens, as shown in FIG. 15, the user opens the lid body 11 approximately 180 degrees and directs the inner surface of the lid body 11 upward. Subsequently, the user lifts the second plate section 101 and the third plate section 102, which hold the PTP sheet 130 of the plate 12, with a hand and brings the second plate section 101 and the third plate section 102 into a flat state. At this time, the first plate section 100 is inclined to be gradually lower toward the lid body 11. The user pushes the storing section 132 from above to drop the drug 131. The dropped drug 131 falls onto the first plate section 100 and rolls onto the top plate 50 of the lid body 11 surrounded by the three sidewalls (the lid front plate 51 and the lid side plates 52 and 53).

After the use, the user can cover the main body 10 with the lid body 11, place the front end portion of the main body 10 in the fixing plate 80 and fix the lid body 11 again, and close the lid body 11.

According to this embodiment, in the container 1 including the fixing mechanism 70 of the lid body 11, when the user pushes the rear plate 22 of the main body 10 and tilts the rear plate 22 forward, the fixing of the lid body 11 to the main body 10 is released and the lid body 11 opens. Therefore, the stored object or content of the stored object can be easily taken out.

The fixing mechanism 70 includes the fixing plate 80 that holds the front end portion of the bottom plate 20 of the main body 10 from below. Therefore, it is possible to realize fixing of the lid body 11 with a simple configuration. The fixing plate 80 is present in a position away from the rear plate 22 operated to release the fixing of the lid body 11. Therefore, a child pays attention to the vicinity of the fixing plate 80 and less easily notices that the child can release the fixing if the child pushes the rear plate 22. The fixing plate 80 is present in the bottom of the container 1. Consequently, it is possible to improve a CR function of the container 1.

The fixing plate 80 is formed from the lid side plate 52 to the lid side plate 53 of the lid body 11. Therefore, it is possible to realize the fixing mechanism 70 having a simple configuration.

The rear ends 23*a* and 24*a* of the side plates 23 and 24 of the main body 10 are inclined to be gradually higher toward the front side. The cutouts 40 are formed in a triangular shape. Therefore, it is possible to appropriately and surely tilt the rear plate 22 forward.

The container 1 includes the plate 12 that holds the stored object. Therefore, it is possible to appropriately and surely hold the stored object.

The plate 12 is connected to the bottom plate 20 of the main body 10. Therefore, it is possible to easily connect the plate 12 and the main body 10.

The plate 12 is detachably attached to the main body 10. Therefore, for example, it is possible to replace the plate 12 according to necessity.

The length of the plate 12 in the front-rear direction is set substantially the same as the length of the internal space of the main body 10 in the front-rear direction. Therefore, when it is attempted to shift the main body 10 to the rear side with respect to the lid body 11 to release the fixing of the lid body 11, the plate 12 on the inside of the main body 10 prevents the movement of the main body 10, whereby it is possible to assist a fixing function for the lid body 11 by the fixing mechanism 70. The plate 12 supports the main body 10 from the inside and performs a function of a reinforcing member. Therefore, it is possible to improve the strength of the main body 10. Further, it is possible to improve durability against repeated use of the main body 10.

Note that, when the length of the plate 12 in the front-rear direction is set slightly larger than the length of the internal space of the main body 10 in the front-rear direction, the plate 12 functions as a spring and urges the main body 10 from the inner side. Therefore, it is possible to maintain the shape of the main body 10. As a result, it is possible to suppress the fixing of the lid body 11 from being released by the own weight of the container 1 at the time when the container 1 is vertically placed or settling at the time when the container 1 is repeatedly used.

The slope 31 that rises toward the front side is formed on the inner surface on the front side of the main body 10. Consequently, the plate 12 pushes the slope 31 when the rear plate 22 tilts forward. Therefore, it is possible to help the lid body 11 to open.

The plate 12 includes the plurality of plate sections 100, 101, and 102. The plurality of plate sections 100 to 102 are connected in series and configured to be able to be folded back in the connecting portions 111 and 112 of the plurality of plate sections 100 to 102. Consequently, the plate 12 can be folded back and three-dimensionally used. Therefore, the plate 12 can hold a sufficient amount of the stored object or the content of the stored object.

The plate 12 includes the first plate section 100 connected to the bottom plate 20 of the main body 10, the second plate section 101 connected to the first plate section 100, and the third plate section 102 connected to the second plate section 101. The stored object is held by the second plate section 101 and the third plate section 102. Consequently, the stored object is held by the two second and third plate sections 101 and 102 on the upper side. Therefore, it is possible to lift the second plate section 101 and the third plate section 102 flat. As a result, it is easy to take out the content of the stored object. Further, it is also easy to take out the content of the stored object present at an end.

One end of the first plate section 100 is connected to the rear side of the bottom plate 20 of the main body 10. The other end of the first plate section 100 is located on the front side of the main body 10. One end of the second plate section 101 is connected to the first plate section 100. The other end of the second plate section 101 is located on the rear side of the main body 10. One end of the third plate section 102 is connected to the second plate section 101. The other end of the third plate section 102 is located on the front side of the main body 10. The lid body 11 includes the sidewalls that surround the three side surfaces formed of the side surface on the front side and the left and right side surfaces. As a result, as shown in FIG. 15, the drug 131 taken out from the second plate section 101 and the third plate section 102 can be received by the first plate section 100. Further, the drug 131 dropped along the inclination of the first plate section 100 can be stored within the three sidewalls (the lid front plate 51 and the lid side plates 52 and 53) of the lid body 11. Therefore, it is possible to suppress the drop of the drug 131.

The PTP sheet 130 of the drugs 131 is stored in the container 1. Therefore, it is possible to easily take out the drugs 131 while securing the CR function.

The preferred embodiment of the present invention is explained above with reference to the accompanying drawings. However, the present invention is not limited to such an example. It is obvious that those skilled in the art can conceive of various change examples and correction examples within the category of the idea described in the claims. The change examples and the correction examples are also naturally understood as belonging to the technical scope of the present invention.

In the configuration of the container 1 in the embodiment, for example, the configurations of the main body 10, the lid body 11, the fixing mechanism 70, the cutouts 40, the plate 12, and the like are not limited to this. The position and the shape of the fixing plate 80 of the fixing mechanism 70 is not limited to this. Further, the fixing mechanism 70 may have other configurations if the fixing mechanism 70 fixes the lid body 11 to prevent the lid body 11 from opening from the main body 10 when the lid body 11 is closed and the fixing is released when the lid body 11 moves to the front side with respect to the main body 10.

In an aspect of the present invention, the cutouts 40 have the triangular shape. However, the shape of the cutouts 40 is not limited to this. A space only has to be formed on the front side of the rear plate 22. For example, the cutouts 40 may have a circular shape or other shapes.

When the lid body 11 is opened, the rear plate 22 only has to tilt forward. The user not only pushes the rear plate 22 with one hand but also, for example, may push a part near the bend line 61. The user may pull the main body 10 or the bottom plate 20 toward the user.

In the embodiment, the plate 12 can be attached to and detached from the bottom plate 20 by the coupling section 103. However, the plate 12 may be fixed to the bottom plate 20 in advance. The plate 12 is attached to the bottom plate 20 of the main body 10. However, the plate 12 may be attached to other portions. Further, the plate 12 includes the three plate sections. However, the plate 12 may include one, two, or four or more plate sections. A member that holds the stored object is not limited to the plate 12.

The stored object may be directly stored in the container 1 without using the plate 12. The PTP sheet 130 can also be connected to the bottom plate 20 of the main body 10. Further, not only the PTP sheet 130 but also other stored objects can be connected to the bottom plate 20 of the main body 10.

The configuration of the PTP sheet 130 is not limited to this. The size of the container 1 of the present invention can be changed as appropriate according to the size of the PTP sheet 130. The material and the size of the PTP sheet 130 are not particularly limited. Further, the PTP sheet 130 may be cut off from the plate 12.

Examples of the drug in the PTP sheet 130 include solid preparation such as a tablet and a capsule. However, the drug is not particularly limited.

An inclination angle of the slope 31 is not particularly limited. The slope 31 may be absent.

In an aspect of the present invention, the stored object is the PTP sheet 130. However, the present invention can also be applied when other stored objects such as a dividedly packed product of a drug, a one-dose package of a plurality of drugs, and a kit preparation of an injection are stored. Note that the stored object may be a stored object including content to be taken out such as the PTP sheet 130 or the stored object itself may be an object to be taken out such as an individual drug. In this way, the stored object stored in the container is not limited at all and may be foods and the like other than medicines.

In an aspect of the present invention, the main body 10 and the lid body 11 of the container 1 are manufactured by bending and assembling cut one piece of paper. The plate 12 is manufactured from another one piece of paper. However, the main body 10, the lid body 11, and the plate 12 can be manufactured from one piece of paper. Consequently, it is also possible to achieve efficiency of productivity.

The shape and the dimensions of the container 1 are not limited to those described in the embodiment. For example, in the embodiment, the dimension in the front-rear direction (the X direction) of the container 1 is longer than the dimension in the left-right direction (the direction orthogonal to the X direction). However, the dimension in the left-right direction of the container 1 may be longer than the dimension in the front-rear direction. In this case, the plate 12 may be stored in the container 1 with the longitudinal direction of the plate 12 directed to the left-right direction of the container 1. The plate 12 may be stored in the container 1 with the longitudinal direction of the plate 12 directed to the front-rear direction of the container 1.

The material of the container 1 and the plate 12 is not particularly limited to the material described above. For example, the material of the container 1 and the plate 12 may be a mixed material of paper, synthetic resin, and the like, wood (plywood), cork, a material obtained by sticking together cork and other materials, a material obtained by sticking together paper and synthetic resin, and the like. In an aspect of the present invention, the container 1 and the plate 12 are made of the same paper. However, the container 1 and the plate 12 may be made of materials different from each other.

INDUSTRIAL APPLICABILITY

The present invention is useful in providing a container from which a stored object or content of the stored object can be easily taken out, although the container includes a fixing function for a lid body.

REFERENCE SIGNS LIST

1 Container
10 Main body
11 Lid body
12 Plate
20 Bottom plate
21 Front plate
22 Rear plate
23 Side plate
24 Side plate
31 Slope
40 Cutout
50 Top plate
51 Lid front plate
52, 53 Lid side plate
70 Fixing mechanism
80 Fixing plate
100 First plate section
101 Second plate section
102 Third plate section
103 Coupling section
130 PTP sheet
131 Drug

What is claimed is:

1. A container comprising:

a main body including at least a bottom plate, a front plate present on a front side surface, a rear plate present on a rear side surface, and side plates present on left and right side surfaces;

a lid body including at least a top plate that is connected to an upper end of the rear plate and covers an upper side of the main body, the lid body being capable of opening and closing the upper side of the main body; and a fixing mechanism that fixes the lid body to prevent the lid body from opening from the main body when the lid body is closed, the fixing being released when the lid body moves to a front side with respect to the main body, wherein cutouts are formed in the side plates of the main body, and the container is configured such that, by the rear plate tilting forward toward the cutouts of the side plates, the lid body moves to the front side with respect to the main body and the fixing of the lid body is released, and as the rear plate and the top plate form a single plane, the top plate rises and the lid body opens.

2. The container according to claim 1, wherein the fixing mechanism includes a fixing plate that holds a front end portion of the bottom plate of the main body from below and fixes the lid body to prevent the lid body from opening.

3. The container according to claim 2, wherein the lid body includes a first lid side plate and a second lid side plate on left and right, and the fixing plate is formed from the first lid side plate to the second lid side plate.

4. The container according to claim 1, wherein rear ends of the side plates incline to be gradually higher toward the front side, and the cutouts are formed in a triangular shape.

5. The container according to claim 1, further comprising a plate that is stored in the main body and that holds a stored object.

6. The container according to claim 5, wherein the plate is connected to the bottom plate of the main body.

7. The container according to claim 5, wherein the plate is detachably attached to the main body.

8. The container according to claim 5, wherein length of the plate in a front-rear direction is set substantially the same as length of an internal space of the main body in the front-rear direction.

9. The container according to claim 5, wherein the plate includes a plurality of plate sections, and the plurality of plate sections are connected in series and configured to be able to be folded back in the connecting portions of the plurality of plate sections.

10. The container according to claim 9, wherein the plate includes a first plate section connected to the bottom plate of the main body, a second plate section connected to the first plate section, and a third plate section connected to the second plate section, and the stored object is held by the second plate section and the third plate section.

11. The container according to claim 10, wherein one end of the first plate section is connected to a rear side of the bottom plate of the main body and another end of the first plate section is located on the front side of the main body, one end of the second plate section is connected to the first plate section and another end of the second plate section is located on the rear side of the main body, one end of the third plate section is connected to the second plate section and another end of the third plate section is located on the front side of the main body, and the lid body includes sidewalls that surround three side surfaces formed of the side surface on the front side and the left and right side surfaces.

12. The container according to claim 5, wherein a material of the plate is selected from paper, synthetic resin, and metal.

13. The container according to claim 1, wherein a slope that rises toward the front side is formed on an inner surface on the front side of the main body.

14. The container according to claim 1, wherein a PTP sheet is stored in the container.

15. The container according to claim 1, wherein at least one selected from a dividedly packed product of a drug, a one-dose package of a plurality of drugs, and a kit preparation of an injection is stored in the container.

16. The container according to claim 1, wherein a material of the container is selected from paper, synthetic resin, and metal.

17. The container according to claim 16, wherein the material of the container is paper.

* * * * *